US010997914B1

(12) United States Patent
Hwang et al.

(10) Patent No.: US 10,997,914 B1
(45) Date of Patent: May 4, 2021

(54) SYSTEMS AND METHODS FOR COMPENSATING PIXEL VOLTAGES

(71) Applicant: Apple Inc., Cupertino, CA (US)

(72) Inventors: Injae Hwang, Cupertino, CA (US); Jiye Lee, Mountain View, CA (US); Yifan Zhang, San Carlos, CA (US); Hyunwoo Nho, Palo Alto, CA (US); Sun-Il Chang, San Jose, CA (US); Junhua Tan, Saratoga, CA (US); Jie Won Ryu, Santa Clara, CA (US); Hyunsoo Kim, Mountain View, CA (US); Myungjoon Choi, Sunnyvale, CA (US); Shiping Shen, Cupertino, CA (US); Kingsuk Brahma, Mountain View, CA (US); Jesse A. Richmond, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/563,286

(22) Filed: Sep. 6, 2019

Related U.S. Application Data

(60) Provisional application No. 62/728,659, filed on Sep. 7, 2018.

(51) Int. Cl.

| | |
|---|---|
| ***G09G 5/10*** | (2006.01) |
| ***G09G 3/3233*** | (2016.01) |
| ***G09G 3/36*** | (2006.01) |
| ***G09G 3/3258*** | (2016.01) |

(52) U.S. Cl.
CPC ..... *G09G 3/3233* (2013.01); *G09G 3/3258* (2013.01); *G09G 3/3688* (2013.01); *G09G 2300/0465* (2013.01); *G09G 2320/029* (2013.01)

(58) Field of Classification Search
CPC .. G09G 3/3233; G09G 3/3258; G09G 3/3688; G09G 2320/029; G09G 2300/0465
See application file for complete search history.

(56) References Cited

U.S. PATENT DOCUMENTS

| | | | | |
|---|---|---|---|---|
| 6,414,661 | B1 | 7/2002 | Shen et al. | |
| 6,995,519 | B2 | 2/2006 | Arnold et al. | |
| 7,321,348 | B2 | 1/2008 | Cok et al. | |
| 7,355,574 | B1 * | 4/2008 | Leon | G09G 3/3233 345/101 |
| 8,914,246 | B2 | 12/2014 | Chaji et al. | |
| 9,818,344 | B2 | 11/2017 | Lin et al. | |
| 9,997,104 | B2 | 6/2018 | Zhang et al. | |
| 10,453,432 | B2 | 10/2019 | Lin et al. | |
| 2008/0218499 | A1 * | 9/2008 | Kohno | G09G 3/3233 345/204 |
| 2008/0231557 | A1 | 9/2008 | Naugler et al. | |

(Continued)

*Primary Examiner* — Adam J Snyder
(74) *Attorney, Agent, or Firm* — Fletcher Yoder, P.C.

(57) ABSTRACT

A system may include a display panel that includes number of pixels that display image data on a display. The system may also include a circuit that measures a voltage associated with a light-emitting diode (LED) of a pixel of the number of pixels in response to the LED receiving a current. In addition to the circuit, the system may employ data processing circuitry that may generate a calibrated prediction model based at least in part on the voltage and the current, such that the calibrated prediction model predicts a change in voltage performance of the LED as the LED ages.

19 Claims, 8 Drawing Sheets

(56) References Cited

U.S. PATENT DOCUMENTS

| | | | | |
|---|---|---|---|---|
| 2012/0299978 | A1* | 11/2012 | Chaji | G09G 3/006 345/690 |
| 2016/0104422 | A1* | 4/2016 | Kishi | G09G 3/006 345/205 |
| 2016/0155377 | A1* | 6/2016 | Kishi | G09G 3/3233 345/214 |
| 2019/0088199 | A1 | 3/2019 | Zhang et al. | |

* cited by examiner

SYSTEMS AND METHODS FOR COMPENSATING PIXEL VOLTAGES

CROSS-REFERENCE TO RELATED APPLICATIONS

This application claims the benefit of U.S. Provisional Application No. 62/728,659, entitled "Systems and Methods for Compensating Pixel Voltages," filed on Sep. 7, 2018, which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain electronic display devices, light-emitting diodes such as organic light-emitting diodes (OLEDs) or active matrix organic light-emitting diodes (AMOLEDs) may be employed as pixels to depict a range of gray levels for display. However, due to various properties associated with the operation of these pixels within the display device, a particular gray level output by one pixel in a display device may be different from a gray level output by another pixel in the same display device upon receiving the same electrical input. More specifically, aging of circuit components, such as the OLED used to emit light, may cause the electrical properties associated with the corresponding pixel current to change, thereby producing inconsistent or non-uniform colors across the display device.

With this in mind, the electrical inputs used to represent image data may be calibrated to account for the aging effects of the OLED by sensing the electrical values that get stored into the corresponding pixel circuit and adjusting the input electrical values accordingly. Since the aging effects of the OLED or other pixel circuit component changes over time, the present disclosure details various systems and methods that may be employed to implement a sensing scheme to sense variations in pixel properties (e.g., current, voltage) and modify a data voltage applied to a respective pixel based at least in part on the sensed variation. The corrected data voltage, when applied to the respective pixel, may compensate for the variations in the pixel properties that may be due to the aging of the pixel circuit component (e.g., LED) to achieve a more uniform image that will be depicted on the display device.

In one embodiment, a compensation system of a display device may sense a pixel current applied to a respective pixel during a panel scan for data program. That is, the compensation system may transmit pixel data (e.g., current over a period of time) to a particular pixel to detect a corresponding voltage of the respective OLED in response to the OLED receiving the pixel data. For example, during a panel scan for one row of pixels, the compensation system may send a test data voltage to drive a thin film transistor (TFT) of a respective pixel. After the test data voltage is transmitted to the TFT, the TFT may provide a corresponding current ($I_{OLED}$) to the OLED of the pixel circuit. As the OLED illuminates in response to receiving the current ($I_{OLED}$), the compensation system may determine a voltage ($V_{OLED}$) across the OLED. As the OLED ages, the voltage ($V_{OLED}$) may decrease when the same current ($I_{OLED}$) is received by the OLED. This decrease in the voltage ($V_{OLED}$) may cause the OLED to display a different color than expected for an input image data. Moreover, as different OLEDs in the display device ages differently, each OLED may react differently to the provided current.

To reduce the visibility of these non-uniform properties across the display device, the compensation system may employ a prediction model that provides an expected current-voltage (I-V) characteristic curve for an OLED over time. The prediction model may be generated by testing certain display devices under various stress conditions (e.g., different test images, different emission times, different ambient temperatures). However, each individual display device may not experience the same aging effects or may not be used in a manner represented by the testing used to generate the prediction model. Accordingly, in some embodiments, the compensation system may calibrate the prediction model based at least in part on the detected voltage ($V_{OLED}$) across the OLED in response to the test current (e.g., $I_{OLED}$) provided to the OLED. That is, the compensation system may compare the relationship between the detected voltage ($V_{OLED}$) and the test current ($I_{OLED}$) to the predicted current-voltage relationship for the display device at the respective time (e.g., period of time of use). Based at least in part on this comparison, the compensation system may calibrate or update the prediction model to more accurately represent the expected voltage behavior with respect to the provided current over time. The calibrated prediction model may now provide a more accurate representation of an error or change in voltage for an input current provided to the OLED.

The compensation system may then use the change in voltage provided by the calibrated prediction model to adjust input pixel data provided to a respective pixel circuit. In other words, image data received by the compensation system that includes pixel data representative of a grey level to be presented by a respective OLED may be adjusted based at least in part on the expected change in voltage provided by the calibrated prediction model. The adjusted image data may then be transmitted to the respective pixel circuit to cause the respective OLED to present light according to the adjusted image data. By employing the compensation system described herein for one or more pixels in a display device, the display device may present image data more uniformly across the display as the OLEDs of the device ages.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
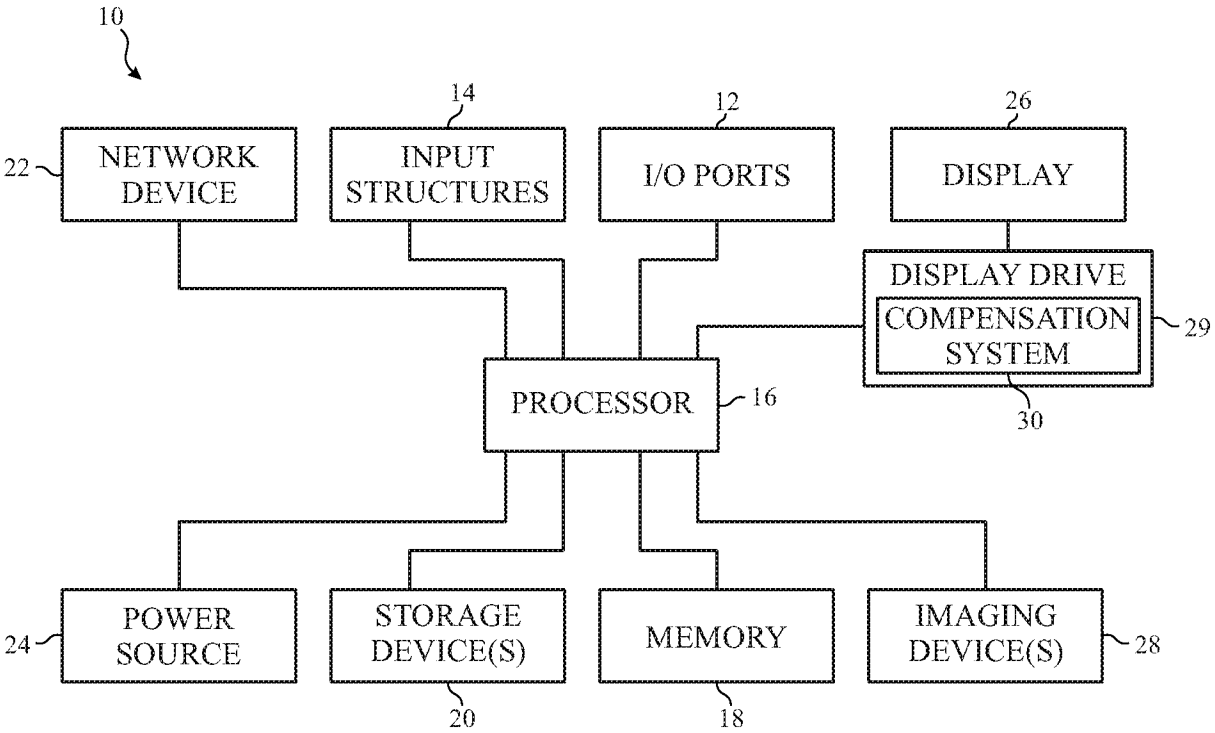
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based at least in part on" B is intended to mean that A is at least partially based at least in part on B. Moreover, the term "or" is intended to be inclusive (e.g., logical OR) and not exclusive (e.g., logical XOR). In other words, the phrase A "or" B is intended to mean A, B, or both A and B.

As electronic displays are employed in a variety of electronic devices, such as mobile phones, televisions, tablet computing devices, and the like, manufacturers of the electronic displays continuously seek ways to improve the consistency of colors depicted on the electronic display devices. For example, given variations in manufacturing, various noise sources present within a display device, aging of circuit components in the display device, or various ambient conditions in which each display device operates, different pixels within a display device might emit a different color value or gray level even when provided with the same electrical input. It is desirable, however, for the pixels to uniformly depict the same color or gray level when the pixels programmed to do so to avoid visual display artifacts due to inconsistent color.

Organic light-emitting diode (e.g., OLED, AMOLED) display panels provide opportunities to make thin, flexible, high-contrast, and color-rich electronic displays. Generally, OLED display devices are current driven devices and use thin film transistors (TFTs) as current sources to provide certain amount of current to generate a certain level of luminance to a respective pixel electrode. OLED Luminance to current ratio is generally represented as OLED efficiency with units: cd/A (Luminance/Current Density or ($cd/m^2$)/($A/m^2$)). Each respective TFT, which provides current to a respective pixel, may be controlled by gate to source voltage ($V_{gs}$), which is stored on a capacitor ($C_{st}$) electrically coupled to the LED of the pixel.

Generally, the application of the gate-to-source voltage $V_{gs}$ on the capacitor $C_{st}$ is performed by programming voltage on a corresponding data line to be provided to a respective pixel. However, as the OLED ages, the OLED may respond differently to the current provided to it. As a result, different OLEDs receiving the same amount of current may react differently, thereby providing non-uniformity in luminance or color across the display.

With the foregoing in mind, the present disclosure describes a system and method for compensating pixel data provided to a respective pixel circuit to cause the respective OLED to react or depict light (e.g., grey level) more uniformly across the display. More specifically, in some embodiments, a compensation system may calibrate a prediction model that predicts an expected change in voltage across an OLED for one or more input current values based at least in part on a detected voltage across the OLED due to a test current at a particular time. Based at least in part on the difference between the expected change in voltage and the actual change in voltage over the OLED, the compensation system may calibrate the prediction model. The calibrated prediction model may then may employed to adjust pixel data of input image data for a respective pixel circuit, such that the OLED may produce a light that more accurately represents the desired image data. Additional details with regard to the manner in which the compensation system may calibrate the prediction model and adjust the pixel data are detailed below with reference to FIGS. 1-11.

By way of introduction, FIG. 1 is a block diagram illustrating an example of an electronic device 10 that may include the sensing system mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, nonvolatile storage 20, network device 22, power source 24, display 26 with a display driver 29, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

The electronic device 10 may include a display driver 29, which may include a chip, such as processor or ASIC, that may control various aspects of the display 26. It should be noted that the display driver 29 may be implemented in the CPU, the GPU, image signal processing pipeline, display pipeline, driving silicon, or any suitable processing device that is capable of processing image data in the digital domain before the image data is provided to the pixel circuitry.

In certain embodiments, the display driver 29 may include a compensation system 30, which may adjust image data provided to the display 26 based at least in part on a calibrated prediction model that predicts how LEDs of the display 26 may change in behavior over time. As will be described in more detail below, the compensation system 30 may test the behavior of one or more OLEDs of the display 26 over time to compensate for aging effects of the respective OLEDs. As a result, the image data presented by the display 26 may be depicted more uniformly across the display 26.

A computer-readable medium, such as the memory 18 or the nonvolatile storage 20, may store the instructions or data to be processed by the processor(s) 16. The memory 18 may include any suitable memory device, such as random access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. In one embodiment, the display 26 may include self-emissive pixels such as organic light emitting diodes (OLEDs) or micro-light-emitting-diodes (μ-LEDs).

Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the electronic device 10 may include a compensation system 30, which may include a chip, such as processor or ASIC, that may control various aspects of the display 26. It should be noted that the compensation system 30 may be implemented in the CPU, the GPU, or any suitable processing device that processes image data in the digital domain before the image data is provided to the pixel circuitry.

Figure 2:
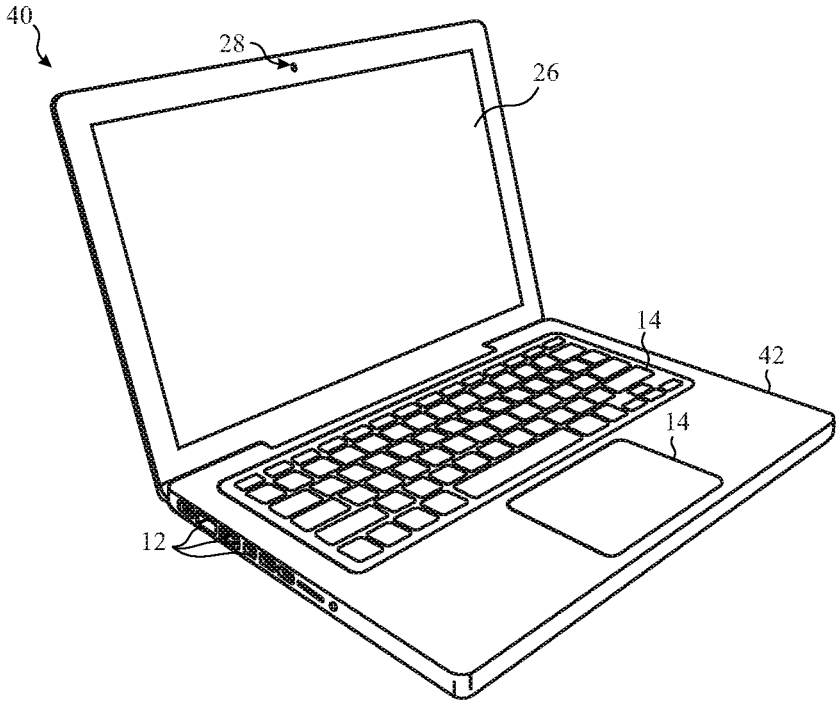
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-5. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 22), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
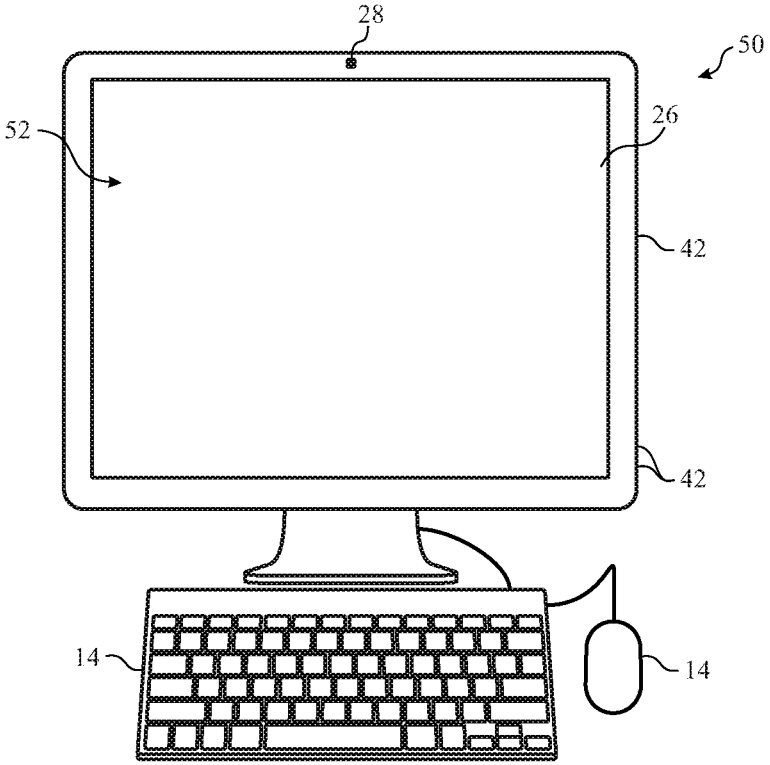
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
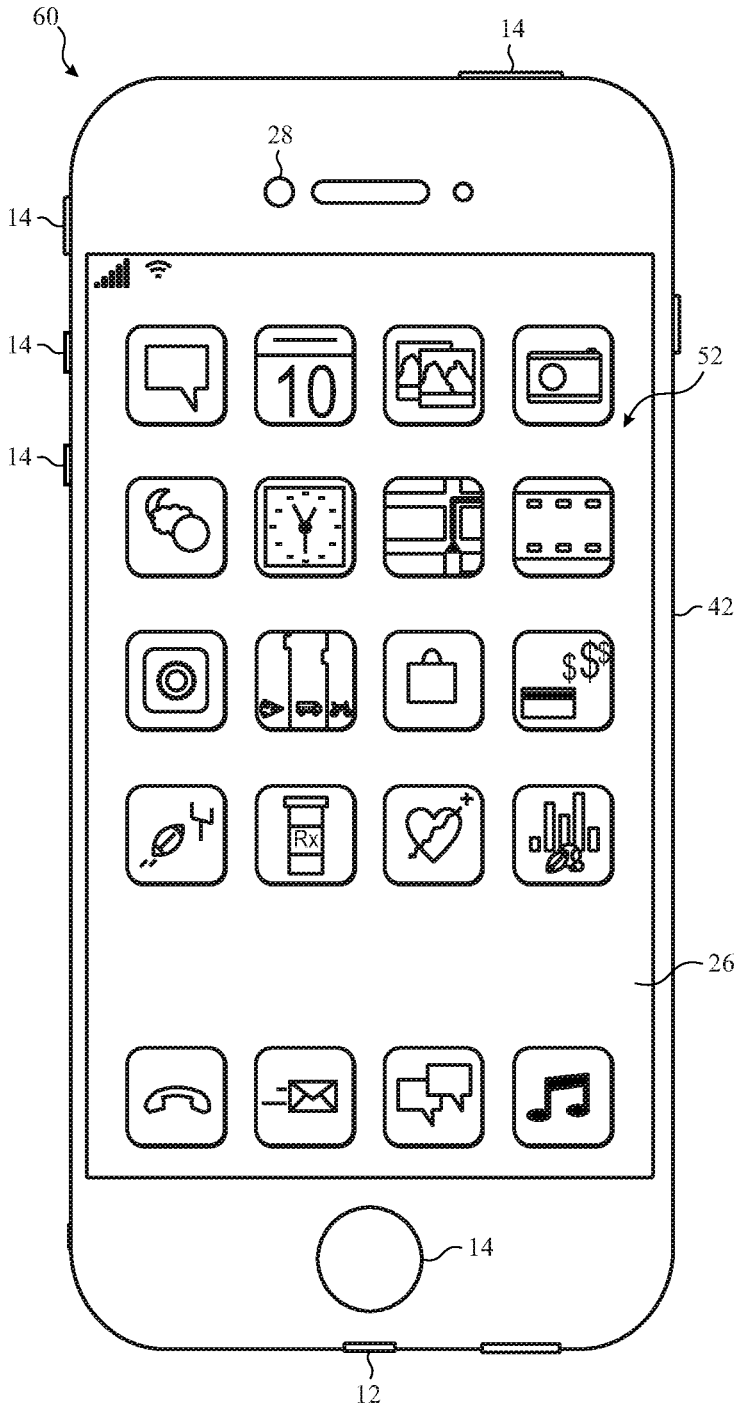
FIG. 4 is a front view of the electronic device of FIG. 1 in the form of a handheld portable electronic device, in accordance with embodiments described herein.
Figure 5:
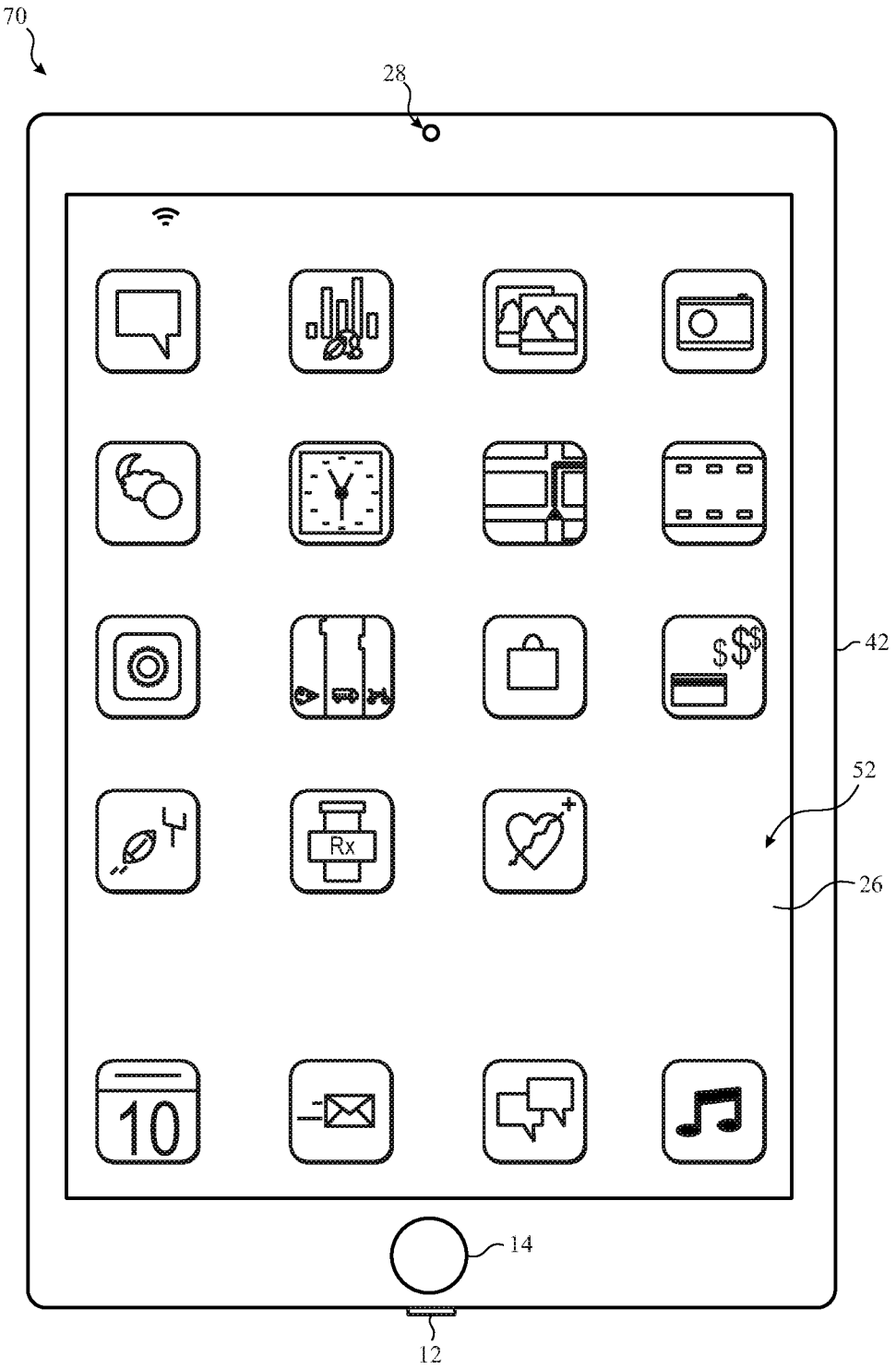
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure 42, which may function to protect the interior components from physical damage and to shield them from electromagnetic interference. The enclosure 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
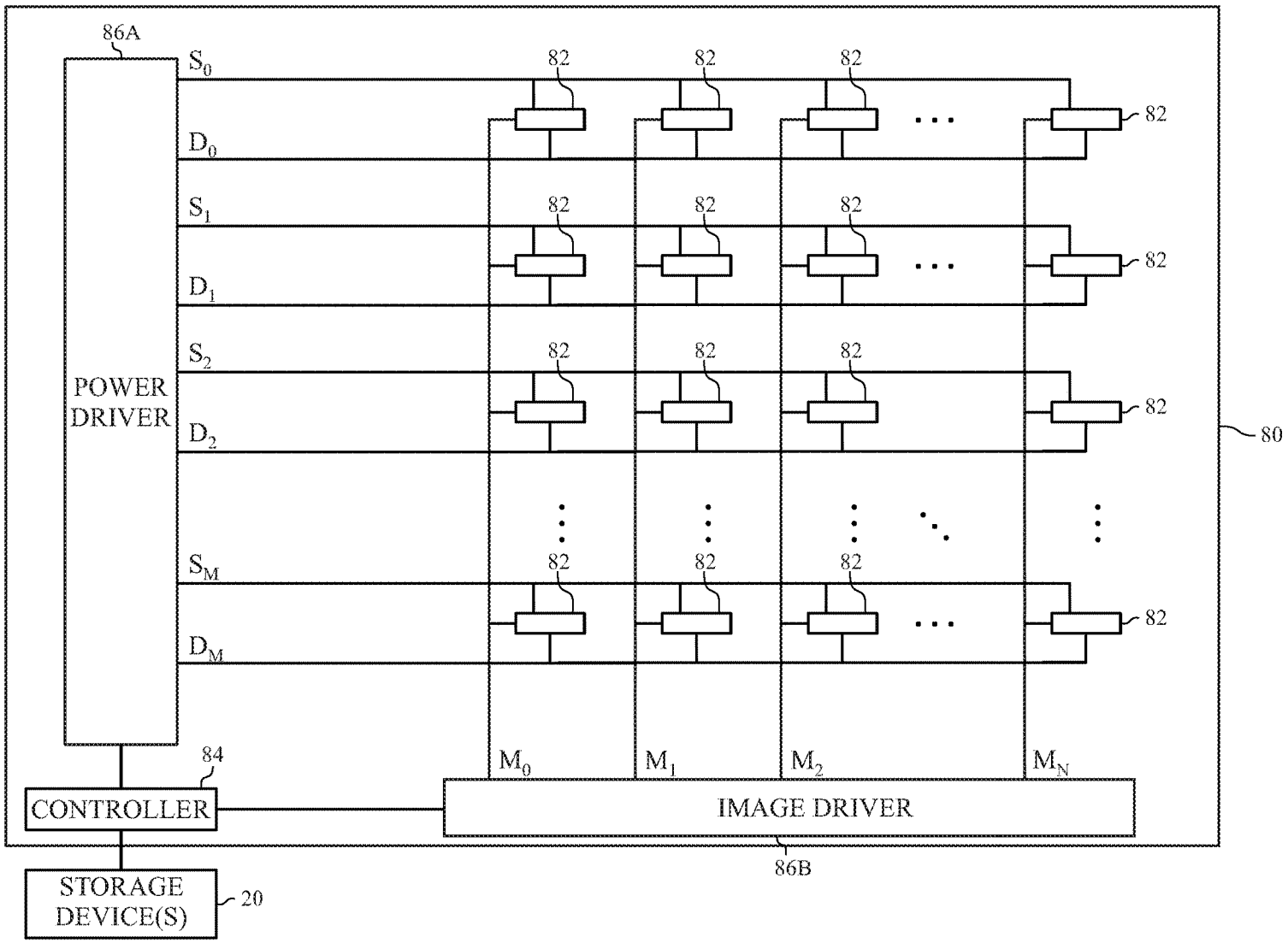
FIG. 6 is circuit diagram of the display of the electronic device of FIG. 1, in accordance with an embodiment.

Having provided some context with regard to possible forms that the electronic device 10 may take, the present discussion will now focus on the compensation system 30 of FIG. 1. As shown in FIG. 6, the display 26 may include a pixel array 80 having an array of one or more pixels 82. The display 26 may include any suitable circuitry to drive the pixels 82. In the example of FIG. 6, the display 26 includes a controller 84, a power driver 86A, an image driver 86B, and the array of the pixels 82. The power driver 86A and image driver 86B may drive individual luminance of the pixels 82. In some embodiments, the power driver 86A and the image driver 86B may include multiple channels for independent driving of the pixel 82. Each of the pixels 82 may include any suitable light emitting element, such as a LED, one example of which is an OLED. However, any other suitable type of pixel may also be used. Although the controller 84 is shown in the display 26, the controller 84 may be located outside of the display 26 in some embodiments. For example, the controller 84 may also be located in the processor 16.

The scan lines S0, S1, . . . , and Sm and driving lines D0, D1, . . . , and Dm may connect the power driver 86A to the pixel 82. The pixel 82 may receive on/off instructions through the scan lines S0, S1, . . . , and Sm and may generate programming voltages corresponding to data voltages transmitted from the driving lines D0, D1, . . . , and Dm. The programming voltages may be transmitted to each of the pixel 82 to emit light according to instructions from the image driver 86B through driving lines M0, M1, . . . , and Mn. Both the power driver 86A and the image driver 86B may be transmitted voltage signals at programmed voltages through respective driving lines to operate each pixel 82 at a state determined by the controller 84 to emit light. Each driver may supply voltage signals at a duty cycle and/or amplitude sufficient to operate each pixel 82.

The intensities of each of the pixels 82 may be defined by corresponding image data that defines particular gray levels for each of the pixels 82 to emit light. A gray level indicates a value between a minimum and a maximum range, for example, 0 to 255, corresponding to a minimum and maximum range of light emission. Causing the pixels 82 to emit light according to the different gray levels causes an image to appear on the display 26. In this manner, a first brightness of light (e.g., at a first luminosity and defined by a gray level) may emit from a pixel 82 in response to a first value of the image data and the pixel 82 may emit a second brightness of light (e.g., at a second luminosity) in response to a second value of the image data. Thus, image data may create a perceivable image output through indicating light intensities to apply to individual pixels 82.

The controller 84 may retrieve image data stored in the storage device(s) 20 indicative of light intensities for the colored light outputs for the pixels 82. In some embodiments, the processor 16 may provide image data directly to the controller 84. The image data may indicate the pixel light intensity and/or refresh rate data. For example, the controller 84 may receive an indication of the refresh rate of the display 26, a desired refresh rate of the display 26, frame and sub-frame period duration, or desired pixel luminance. The controller 84 may control the pixel 82 by using control signals to control elements of the pixel 82.

The pixel 82 may include any suitable controllable element, such as a transistor, one example of which is a metal-oxide-semiconductor field-effect transistor (MOSFET). However, any other suitable type of controllable elements, including thin film transistors (TFTs), p-type and/or n-type MOSFETs, and other transistor types, may also be used.

Figure 7:
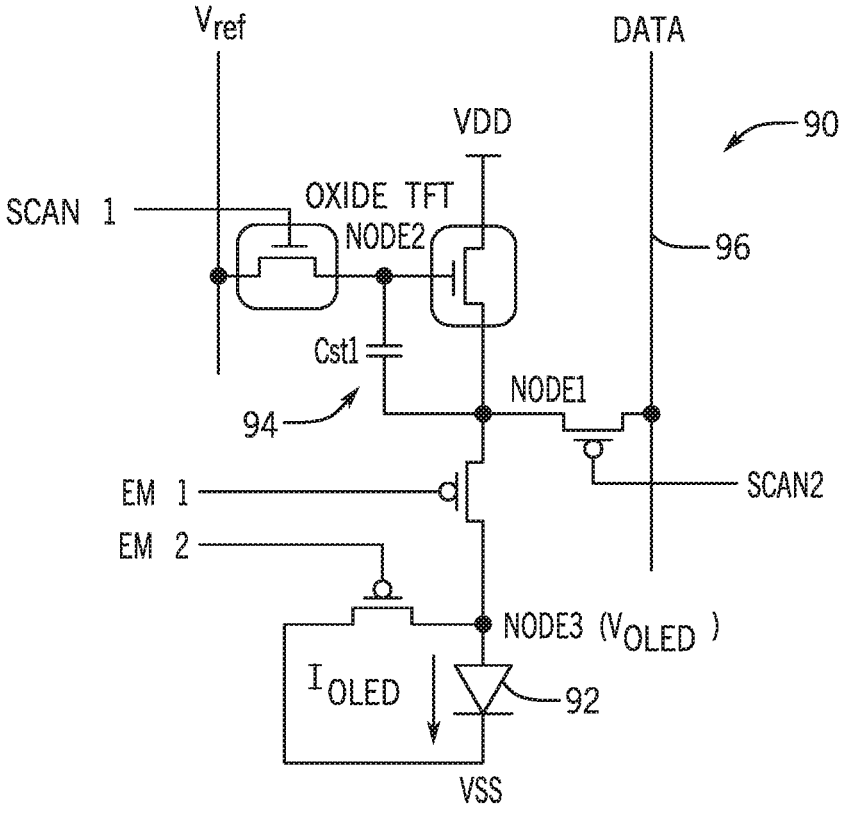
FIG. 7 is a circuit diagram of an example pixel driving circuit for a pixel in the display of the electronic device of FIG. 1, in accordance with an embodiment.

In some embodiments, the pixel 82 may include a number of circuit components to enable the respective LED produce light for a prescribed amount of time or produce a particular gray level. By way of example, FIG. 7 illustrates a pixel driving circuit 90 that may include a number of semiconductor devices that may coordinate the transmission of data signals to an organic light-emitting diode (LED) 92 of a respective pixel 82. In one embodiment, the pixel driving circuit 90 may receive input signals (e.g., emission signals 1 and 2, scan signals 1 and 2), which may be coordinated in a manner to cause the pixel driving circuit 90 to display image data and transmit a test data signal used to determine the OLED voltage ($V_{OLED}$) (e.g., voltage at Node 3) of the OLED 92.

With this in mind, the pixel driving circuit 90 may include, in one embodiment, N-type semiconductor devices and P-type semiconductor devices, as shown in FIG. 7. Although the following description of the pixel driving circuit 90 is illustrated with the N-type semiconductor devices and the P-type semiconductor devices, it should be noted that the pixel driving circuit 90 may be designed using any suitable combination of N-type or P-type semiconductor devices.

In addition to the semiconductor devices, the pixel driving circuit 90 may include a capacitor 94 that may store data provided via data line 96. The close proximity between the various circuit components of the pixel driving circuit 90 and the various voltage sources (e.g., VDD, VSS) may also create parasitic capacitance within the pixel driving circuit 90. The capacitor 94 and the parasitic capacitance of the pixel driving circuit 90 may be combined in a capacitance ratio that represents the total capacitance of the pixel driving circuit 90.

In some embodiments, one or more of the semiconductors (e.g., TFTs) of the pixel driving circuit 90 may produce a current in response to the voltage received via the data line 96. When the emission signal 1 (e.g., EM1) is provided to a gate of the respective switch, the OLED 92 may receive a current that corresponds to the data stored in the capacitor 94. As the OLED 92 illuminates in response to receiving the current ($I_{OLED}$), a voltage (e.g., $V_{OLED}$) at Node 3 may change when the OLED 92 receives the same amount of current over time. This change in voltage is representative of the aging effects of the OLED 92.

Figure 8:
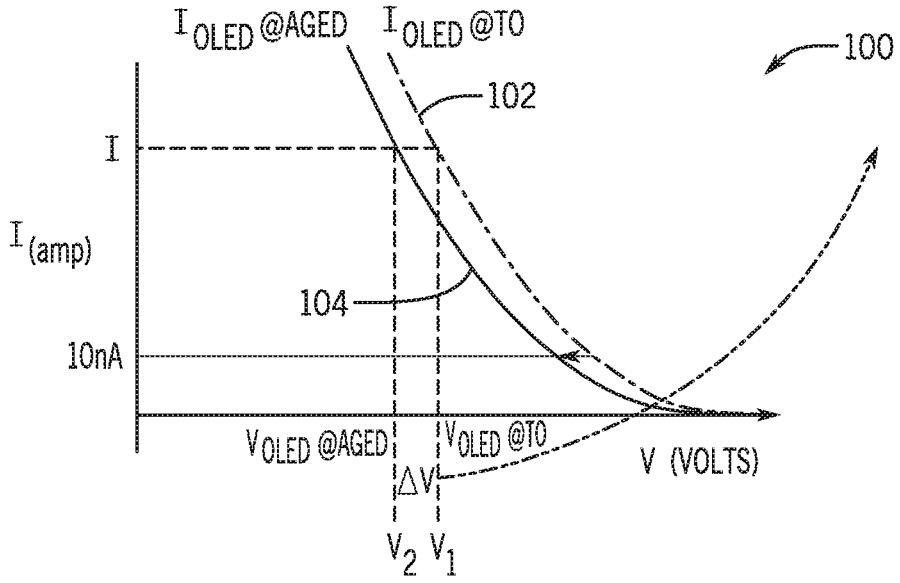
FIG. 8 is a graph illustrating changes to current-to-voltage relationships of an organic light emitting diode (OLED) in the display of the electronic device of FIG. 1 over time, in accordance with an embodiment.

To further illustrate the aging effects of the OLED 92, FIG. 8 illustrates a graph 100 of a current-to-voltage relationship of an example OLED. As shown in the graph 100, curve 102 represents the current $I_{OLED}$ conducted via the OLED 92 at time $T_0$ and curve 104 represents the current $I_{OLED}$ conducted via the OLED 92 at a later time (e.g., $T_{AGED}$) after the OLED 92 has been in use and aged. As shown in FIG. 8, when the current $I_{OLED}$ is at current I for time $T_0$ and time $T_{AGED}$, the curve 102 indicates that the OLED voltage ($V_{OLED}$) is $V_1$, and the curve 104 indicates that the OLED voltage ($V_{OLED}$) is $V_2$. As such, although the OLED 92 receives the same amount of current $I_1$, the voltage across the OLED 92 decreases. This change in voltage changes the behavior (e.g., luminance) of the OLED 92.

Figure 9:
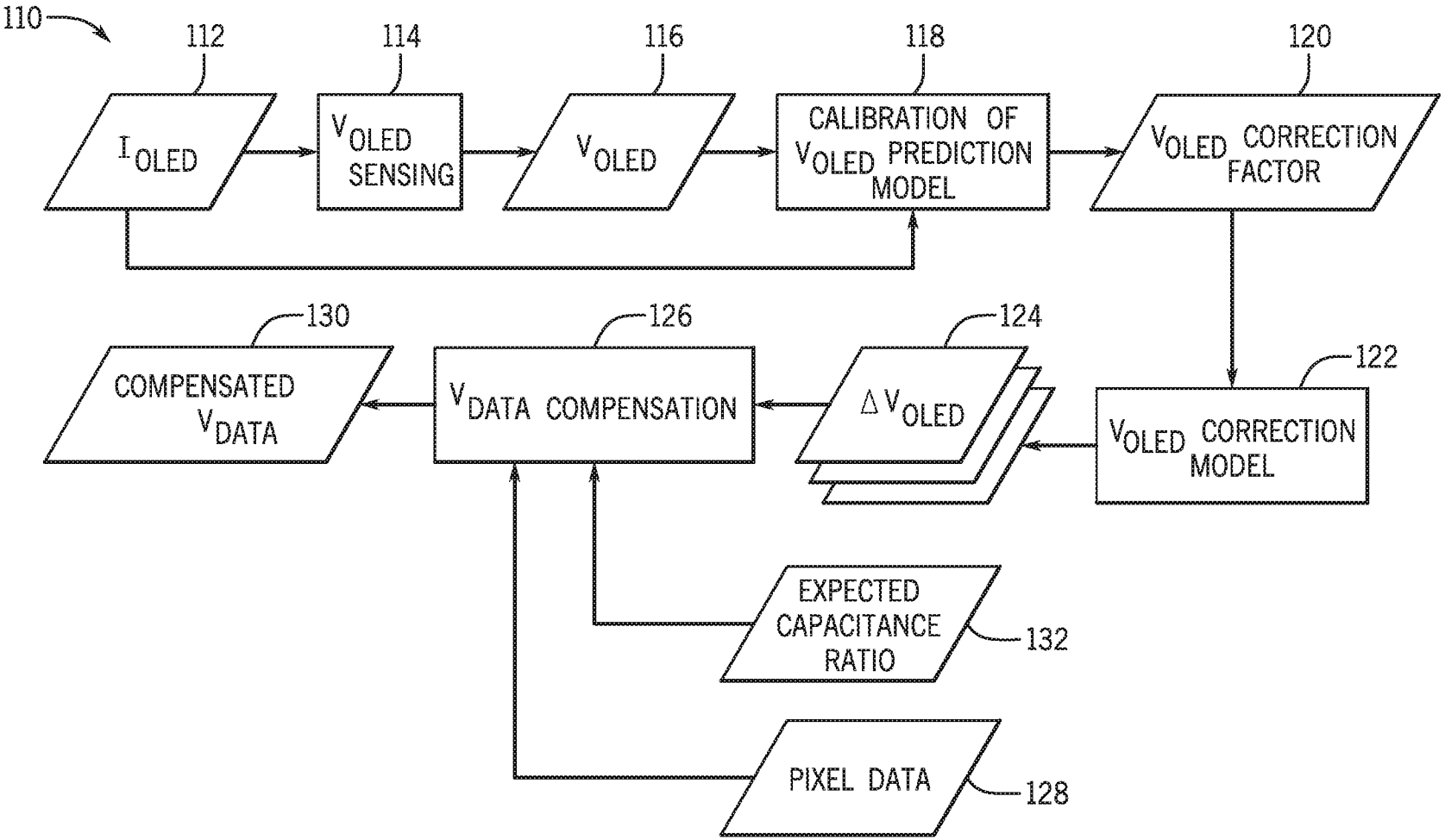
FIG. 9 is a data flow diagram representative of a process for compensating pixel data for display via the display of the electronic device of FIG. 1 as the display ages, in accordance with an embodiment.

Keeping this in mind, FIG. 9 illustrates a data flow diagram 110 for compensating input pixel data for a respective pixel 82 to achieve a more uniform properties across the display 26. In some embodiments, the data flow diagram 110 may be performed by the processor 16, the display driver 29, the compensation system 30, or other suitable processing component. In addition, it should be noted that the data flow diagram 110 may be implemented in software via data processing circuitry (e.g., image signal processor, data processing pipeline, image data processing pipeline), using hardware components, or a combination of software and hardware components. In some embodiments, the data processing circuitry that performs the operations related to the data flow diagram 110 and other related processes described herein may be performed external to the display 26. For the purposes of discussion, the following description of the data flow diagram 110 will be described as being performed by the compensation system 30, but it should be noted that the process should not be limited to be being performed by the compensation system 30.

Referring now to FIG. 9, the data flow diagram 110 may involve sending an indication to a voltage sensing component 114 that the current $I_{OLED}$ 112 is provided to the OLED 92. The current $I_{OLED}$ 112 may represent an amount of current that is provided to the OLED 92. The current $I_{OLED}$ 112 may be sensed using sensing circuitry or may correspond to a known test current value.

After receiving indication that the current $I_{OLED}$ 112 is provided to the OLED 92, the voltage sensing component 114 may sense or measure a voltage $V_{OLED}$ 116 at an anode of the OLED 92 (e.g., at node 3). The voltage $V_{OLED}$ 116 may then be used by a calibration component 118 to calibrate a prediction model for the behavior of the OLED 92 over time. The calibration component 118 may determine whether the voltage $V_{OLED}$ 116 matches an expected voltage for the current $I_{OLED}$ 112. That is, a prediction model for the voltage $V_{OLED}$ 116 may indicate an expected voltage value to be measured at the Node 3 for the OLED 92 after the display 26 has been in use for a certain amount of time. The prediction model may be generated during the manufacturing phase of the display 26 or under a testing phase of the display 26. As such, the display 26 and the corresponding pixels 82 may have been aged using stress tests under various pixel data conditions, luminance conditions, and the like. In one example, the prediction model may observe the decrease in the OLED voltage over time, as the respective pixel 82 continuously displayed a particular grey level.

Based at least in part on the difference between the expected voltage value of the OLED 92 according to the prediction model and the measured voltage $V_{OLED}$ 116, the calibration component 118 may determine a correction factor 120 for the voltage $V_{OLED}$ 116. The correction factor may represent the difference or error between the expected voltage value for the OLED 92 after the OLED 92 has been in use for a certain amount of time according to the prediction model and the measured voltage $V_{OLED}$ 116.

The correction factor 120 may be provided to a prediction model component 122, which may adjust its prediction model based at least in part on the correction factor 120. In one embodiment, the prediction model component 122 may include the prediction model for the expected voltages of the OLED at one or more input currents ($I_{OLED}$) at various times or ages for the display 26. The prediction model may be stored as a look-up-table, an algorithm, or the like. The algorithm may correspond to an expected voltage decay curve that represents the measured decay in OLED voltage over time for the input current $I_{OLED}$, as determined during testing, simulation, or the like.

After the prediction model component 122 calibrates the prediction model, the prediction model component 122 may produce one or more delta voltage values 124 that represent a current-to-voltage relationship (e.g., I-V curve) for the OLED 92. In one embodiment, the prediction model component 122 may produce at least three delta voltage values 124 that represent the change in voltage at the OLED 92 at three different input current values. In this way, the delta voltage values 124 represent a more accurate current-to-voltage relationship between a current $I_{OLED}$ provided to the OLED 92 and the corresponding voltage $V_{OLED}$ measured at the anode of the OLED 92.

Using the one or more delta voltage values 124, a voltage compensator component 126 may adjust input pixel data 128 received by the pixel driving circuit 90. That is, the voltage compensator component 126 may generate a compensated pixel voltage 130 based at least in part on the pixel data 128 and the expected current-to-voltage relationship between the input current (e.g., pixel data 128) and the corresponding voltage applied to the OLED 92. In one embodiment, the pixel data 128 may represent a current amount provided to the OLED 92 to produce a particular grey level. Using the current-to-voltage relationship determined based at least in part on the one or more delta voltage values 124, the data voltage compensator component 126 may determine a voltage that should be applied to the OLED 92 to enable the aged OLED 92 to produce the expected amount of light or grey level. The data voltage compensator component 126 may then output the compensated pixel voltage 130 to the pixel driving circuit 90 via the data line 96, thereby causing the OLED 92 to receive the appropriate current $I_{OLED}$ to depict the desired grey level indicated in the pixel data 128.

In certain embodiments, the capacitance ratio of the pixel driving circuit 90 may cause the OLED 92 to operate differently. As such, the data voltage compensator component 126 may also receive an expected capacitance ratio 132 of the respective pixel driving circuit 90 and use a product between the expected capacitance ratio 132 and the one or more delta voltage values 124 to determine the current-to-voltage relationship between a current $I_{OLED}$ provided to the OLED 92 and the corresponding voltage $V_{OLED}$ measured at the anode of the OLED 92. By accounting for the capacitance ratio 132 of the pixel driving circuit 90, the data voltage compensator component 126 may provide a more accurate representation of the current-to-voltage relationship between a current $I_{OLED}$ provided to the OLED 92 and the corresponding voltage $V_{OLED}$ measured at the anode of the OLED 92.

Figure 10:
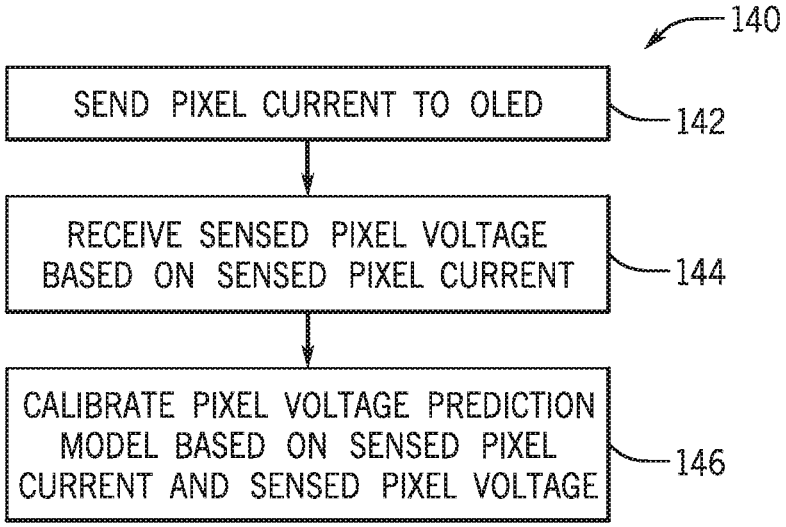
FIG. 10 is a flow chart of a method for calibrating a prediction model of a current-to-voltage changes of the OLED over time in the display of the electronic device of FIG. 1 as the display ages, in accordance with an embodiment.

With the foregoing in mind, FIG. 10 illustrates a flow chart of a method 140 for calibrating the prediction model discussed above with reference to FIG. 9. For the purposes of discussion, the following description of the method 140 will be described as being performed by the compensation system 30, but it should be noted that any suitable processing device may perform the method 140. Moreover, although the method 140 is described in a particular order, it should be understood that the method 140 may be performed in any suitable order.

Referring now to FIG. 10, at block 142, the compensation system 30 may send a pixel current ($I_{OLED}$) to the OLED 92 of a particular pixel 82 in the display 26. The pixel current ($I_{OLED}$) may be a test value that is known to the compensation system 30, used for testing the aging parameter of the OLED 92 during manufacturing, used to generate the prediction model described above, or the like.

At block 144, the compensation system 30 may receive a sensed pixel voltage ($V_{OLED}$) that may correspond to the voltage at the anode of the OLED 92 (e.g., Node 3) while the OLED 92 is receiving the pixel current ($I_{OLED}$). In some embodiments, the pixel voltage ($V_{OLED}$) may be measured using measurement circuitry, determined based at least in part on other detected electrical properties in the pixel driving circuit, or the like.

After receiving the sensed pixel voltage ($V_{OLED}$), at block 146, the compensation system 30 may calibrate a prediction model that characterizes the expected relationship between the pixel current ($I_{OLED}$) and the pixel voltage ($V_{OLED}$) at various times as the OLED 92 ages. To calibrate the prediction model, in some embodiments, the compensation system 30 may determine an amount of time in which the OLED 92 has been in operation (e.g., time illuminated) and identify a corresponding indication in the prediction model representative of the expected pixel current and voltage relationship at that time. By way of example, the prediction model may be stored in the storage device 20 or the like as a look-up table that includes a collection of current values ($I_{OLED}$) a corresponding collection of voltage values ($V_{OLED}$) at various times (e.g., OLED aging hours). In another example, the prediction model may be represented by a number of current-voltage (I-V) curves that indicates a relationship between the pixel current values ($I_{OLED}$) and the pixel voltage values ($V_{OLED}$) at various points in time that correspond to the aging of the OLED 92.

In any case, the compensation system 30 may calibrate the prediction model by determining a difference between the expected pixel voltage for the pixel current ($I_{OLED}$) as indicated in the prediction model and the sensed pixel voltage ($V_{OLED}$) received at block 144. In some embodiments, the compensation system 30 may update the values of the prediction model based at least in part on the difference. The values of the prediction model may include delta values (e.g., $\Delta_{VOLED}$) that represent a change in voltage for pixel data provided to the display 26. That is, the voltage delta values may indicate how pixel data (e.g., image data) provided to the display 26 should be adjusted to cause the OLED 92 to more accurately depict a desired luminance or color value, as defined in input image data. As a result, the prediction model may more accurately represent the aging effects to the current-voltage relationship at the OLED 92.

Figure 11:
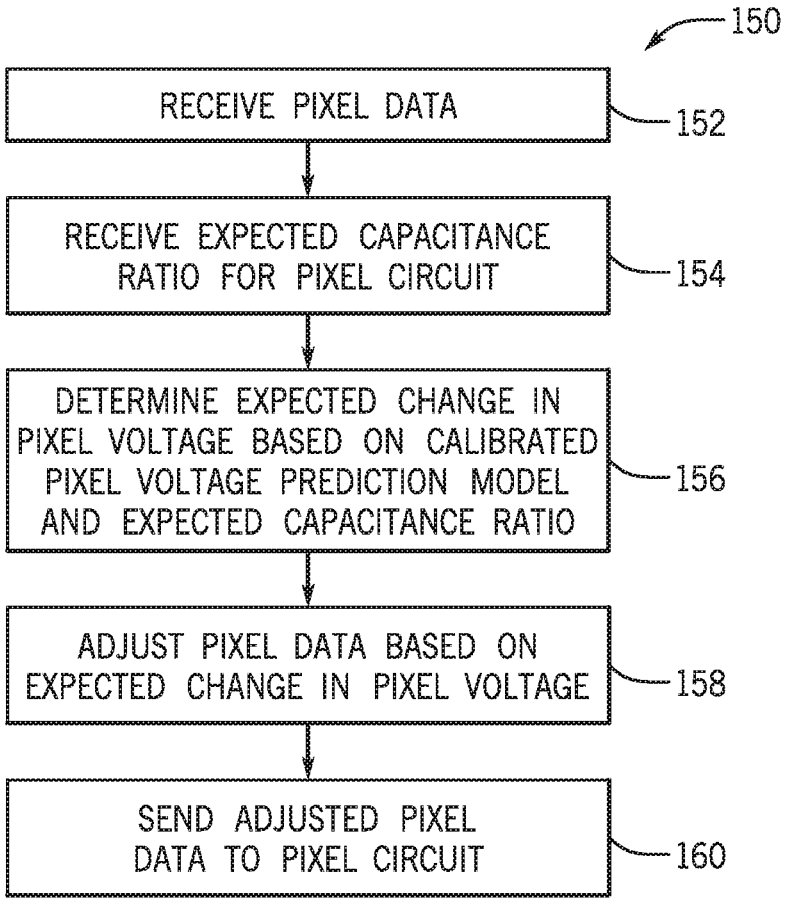
FIG. 11 is a flow chart of a method for compensating pixel data for display via the display of the electronic device of FIG. 1 based at least in part on the calibrated prediction model, in accordance with an embodiment.

After the prediction model is calibrated, the compensation system 30 may use the calibrated prediction model to adjust image data received by the processor 16 or the like to reduce the effects due to the aging of the OLED 92. With this in mind, FIG. 11 illustrates a flow chart of a method 150 for adjusting image data to be depicted via the display 26 in accordance with the embodiments described herein. Like the method 140, the following description of the method 150 will be described as being performed by the compensation system 30, but it should be noted that any suitable processing device may perform the method 150. Moreover, although the method 150 is described in a particular order, it should be understood that the method 150 may be performed in any suitable order, including omitting certain operations.

Referring now to FIG. 11, at block 152, the compensation system 30 may receive pixel data (e.g., image data) that may correspond to a desired luminance and/or color (e.g., grey level) for the OLED 92. In one embodiment, the pixel data may include a grey level or luminance for different subpixels (e.g., red, green, blue) of the pixel 82. The pixel data may correspond to a pixel current ($I_{pixel}$) that may be provided to the OLED 92 to cause the OLED 92 to depict a luminance or color that corresponds to the pixel data.

At block 154, the compensation system 30 may receive a capacitance ratio of the pixel driving circuit 90. As mentioned above, the capacitance ratio may represent the capacitance of the pixel driving circuit 90 for the respective pixel 82 that the pixel data is directed towards. The capacitance of the pixel driving circuit 90 may include the capacitors of the circuit itself and any expected parasitic capacitance that is expected to be present in the pixel driving circuit 90.

Based at least in part on the pixel data received at block 152, the compensation system 30 may, at block 156, determine an expected change in pixel voltage based at least in part on the calibrated prediction model described above with reference to FIG. 9. In some embodiments, the compensation system 30 may use the pixel current ($I_{pixel}$) and any suitable indication of the age of the respective OLED 92 as an index to query the calibrated prediction model. The age of the respective OLED 92 may be determined by the compensation system 30 based at least in part on data indicative of an amount of time that the OLED 92 has been illuminated, an amount of time that the electronic device 10 has been in use, or other suitable methods. As such, the compensation system 30 may retrieve one or more voltage delta values that represent how the pixel data should be adjusted to cause the OLED 92 to depict the desired luminance and color value despite the aging of the OLED 92.

In certain embodiments, the calibrated prediction model may provide at least three voltage delta values (e.g., $\Delta N_{gs1,2,3}$) for three pixel currents (e.g., $I_{pixel1,2,3}$) that can be plotted, such that the compensation system 30 may determine a curve that describes the voltage adjustments to apply to a variety of pixel currents, as specified by the pixel data. The compensation system 30 may then, at block 158, use the determined voltage adjustments to adjust the pixel data (e.g., voltage representative of a grey level for the OLED 92). That is, the compensation system 30 may increase or decrease the pixel data received at block 152 based at least in part on the expected change in pixel voltage determined via the calibrated prediction model.

In some embodiments, the compensation system 30 may multiply the expected change in pixel voltage as provided by the prediction model by the capacitance ratio received at block 154. In this way, the compensation system 30 may account for the capacitance of the pixel driving circuit 90 when determining the voltage delta values (e.g., $\Delta_{gs1,2,3}$) to use to determine the adjusted pixel data. The resulting product of the expected change in pixel voltage as provided by the prediction model and the capacitance ratio received at block 154 may be used to determine the at least three voltage delta values (e.g., $\Delta_{gs1,2,3}$) for three pixel currents (e.g., $I_{pixel1,2,3}$) that can be plotted, such that the compensation system 30 may determine a curve that describes the voltage adjustments to apply to a variety of pixel currents, as described above.

At block 160, the compensation system 30 may transmit the adjusted pixel data to the respective pixel driving circuit 90 to cause the respective OLED 92 to depict the desired grey level. As a result, the display 26 may present image data with reduced image artifacts that are caused by pixel current drops due to non-ideal bootstrapping in the pixel driving circuit 90, parasitic capacitance present in the pixel driving circuit 90, the aging of the OLED 92, and the like.

By employing the systems and methods described herein, the prediction model for aging effects to OLEDs may be improved to more accurately represent the aging of the actual OLEDs in the respective display devices. That is, the prediction models may generally be created based at least in part on an expected behavior of the OLEDs over time, but each individual OLED and display device may be manufactured using different processes, be composed of different types of material, operated in different manners, be stored in different ambient conditions, and the like. As such, the presently disclosed embodiments may enable the prediction model for a particular display device to more accurately represent the effects of the OLED aging. In addition, in some embodiments, the prediction model may be calibrated at certain times and the calibrated prediction model may be used to adjust pixel data during the operation of the display device. In this way, the pixel voltage ($V_{OLED}$) sensing frequency may be reduced, as the prediction model may be relied on to provide an accurate representation of the aging effects of the OLED.

Although the foregoing description of the embodiments for improving the uniformity of the display 26 is described with respect to OLED aging, it should be noted that the embodiments presented herein are not limited to being applied to OLEDs. Instead, the presently disclosed embodiments may be applied to any suitable light emitting diode used in an electronic display.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A system comprising:

a display panel comprising a plurality of pixels configured to display image data;

a circuit configured to measure a voltage associated with a light-emitting diode (LED) of a pixel of the plurality of pixels in response to the LED receiving a current; and data processing circuitry configured to:

receive a prediction model for predicting a change in voltage performance of the LED as the LED ages; and calibrate the prediction model based on a plurality of test currents provided to the LED at a plurality of times, wherein the prediction model is calibrated by:

acquiring a measured voltage at the LED after each test current of the plurality of test currents is provided to the LED;

determining a difference between the measured voltage at the LED after each test current of the plurality of test currents is provided to the LED and an expected voltage associated with each test current at the plurality of times, wherein the expected voltage is retrieved from the prediction model; and updating the prediction model based on the difference.

2. The system of claim 1, wherein the data processing circuitry is configured to:

receive pixel data representative of image data to be depicted on the pixel; and generate adjusted pixel data based at least in part on the calibrated prediction model and the pixel data, wherein the adjusted pixel data is configured to be displayed on the display panel.

3. The system of claim 2, wherein the data processing circuitry is configured to use a capacitance ratio associated with the pixel to generate the adjusted pixel data based at least in part on the calibrated prediction model, the pixel data, and the capacitance ratio.

4. The system of claim 3, wherein the data processing circuitry is configured to generate the adjusted pixel data based at least in part on a product between the capacitance ratio and one or more values provided via the calibrated prediction model.

5. The system of claim 3, wherein the capacitance ratio is representative of a capacitance of a pixel driving circuit associated with the pixel.

6. The system of claim 5, wherein the capacitance comprises a parasitic capacitance of the pixel driving circuit.

7. The system of claim 1, wherein the calibrated prediction model comprises at least three delta voltage values representative of at least three differences between at least three expected measured voltages associated with the LED and at least three input currents provided to the LED.

8. The system of claim 1, wherein the display panel and the circuit configured to measure the voltage are disposed as components of an electronic display, and wherein the data processing circuitry is disposed as external to the electronic display.

9. A method, comprising:

sending a test current to a light-emitting diode (LED) of a pixel circuit;

measuring a voltage associated with the LED in response to the LED receiving the test current;

determining a difference between the voltage at the LED after the test current is provided to the LED and an expected voltage associated with the test current, wherein the expected voltage is retrieved from a prediction model, wherein the prediction model comprises information indicative of a plurality of relationships between an expected voltage associated with the LED and a target current provided to the LED at a plurality of times; and updating the prediction model based on the difference.

10. The method of claim 9, wherein each of the plurality of times corresponds to a different age of the LED.

11. The method of claim 9, wherein the LED comprises an organic light-emitting diode.

12. The method of claim 9, wherein the prediction model is generated based at least in part on testing a second LED that is representative of the LED under a plurality of stress conditions.

13. The method of claim 12, wherein the plurality of stress conditions comprises illuminating the LED for one or more amounts of time.

14. The method of claim 9, wherein calibrating the prediction model comprises adjusting the expected voltage associated with the LED based at least in part on the voltage measured at the LED.

15. The method of claim 9, wherein the prediction model comprises one or more changes in voltage associated with the LED as the LED ages.

16. A non-transitory computer-readable medium comprising computer-executable instructions that, when executed, cause a processor to:

receive pixel data representative of a grey level for display via a light-emitting diode (LED) of a pixel in an electronic device;

receive an indication of an age of the LED;

query a prediction model indicative of a change in voltage associated with the pixel data using the pixel data and the age, wherein the prediction model comprises information indicative of a plurality of relationships between an expected voltage associated with the LED and pixel current provided to the LED at a plurality of times;

adjust the pixel data based at least in part on the change in voltage, wherein the adjusted pixel data is configured to cause a pixel driving circuit associated with the LED to more uniformly display an image;

calibrate the prediction model calibrated by:

sending a test current to the LED;

measuring a pixel voltage at the LED in response to the LED receiving the test current;

determining a difference between the pixel voltage at the LED and an expected pixel voltage associated with the test currents, wherein the expected pixel voltage is retrieved from the prediction model; and updating the prediction model based on the difference.

17. The non-transitory computer-readable medium of claim 16, wherein the age of the LED corresponds to an amount of time that the LED is illuminated.

18. The non-transitory computer-readable medium of claim 16, wherein the information comprises at least three delta voltage values and at least three current values representative of current provided to the LED to present a grey level.

19. The non-transitory computer-readable medium of claim 18, wherein the computer-executable instructions cause the processor to query the prediction model by analyzing the pixel data with respect to a curve that comprise the at least three delta voltage values and the at least three current values.

* * * * *